US006594888B2

(12) United States Patent
Chang

(10) Patent No.: US 6,594,888 B2
(45) Date of Patent: Jul. 22, 2003

(54) SQUEEZING TOOL FOR COAXIAL CABLE CONNECTOR

(76) Inventor: Chi-Fu Chang, No. 16, Alley 10, Lane 187, Sec. 1, Li-Nung St., Peito District, Taipei (TW)

( * ) Notice: Subject to any disclaimer, the term of this patent is extended or adjusted under 35 U.S.C. 154(b) by 59 days.

(21) Appl. No.: 09/818,551

(22) Filed: Mar. 28, 2001

(65) Prior Publication Data

US 2002/0138975 A1 Oct. 3, 2002

(51) Int. Cl.[7] ..... H01R 43/042
(52) U.S. Cl. ..... 29/751; 29/753; 29/758
(58) Field of Search ..... 29/750, 751, 753, 29/748, 758, 764, 869; 81/313, 355, 439, 440; 439/133, 135, 136; 72/409.14

(56) References Cited

U.S. PATENT DOCUMENTS 6,293,004 B1 * 9/2001 Holliday ..... 29/751

* cited by examiner

*Primary Examiner*—Gregory Huson
*Assistant Examiner*—Peter deVore
(74) *Attorney, Agent, or Firm*—Troxell Law Office PLLC

(57) ABSTRACT

A squeezing tool for coaxial cable connector, to be used for a coaxial cable interconnected to a coupling means, which comprises a tilted module support, two tilted movable modules being coaxially deployed in the tilted module support to support the connector of the coupling means. The coupling means is assembled with one end of the cable in a manner free from compression, tension, or pressure, plus a grip brought to advance or regress along the surface of the module axialwise by means of a cranket means. The connector coupling section is eventually thrusted into the module, while application of force axialwise is permitted to bring the module compressed into the module support. Meanwhile the perimeter of one end of the connector coupling section is uniformly squeezing to shrink essentially conically to facilitate coupling to the cable.

3 Claims, 4 Drawing Sheets

SQUEEZING TOOL FOR COAXIAL CABLE CONNECTOR

BACKGROUND OF THE INVENTION (1) Field of the Invention

A squeezing tool for coaxial cable connector, more specifically means such that by the exertion of extrusion or application of pressure the perimeter of one end of the connector section of the coupling means is uniformly squeezing to an essentially conical configuration, to facilitate coupling to a cable object.

(2) Description of the Prior Art

In the industry of manufacturing of coaxial cable products, a common practice is to attach, using a hand-held clamp, a standard coupling means is the connected to another match coupling, or else to the signal port of a TV receiver set.

A common clamp in use for today for such purpose is in the form of a hexagonal adaptor, squeezed to shape by compression applied to the cable end, duly sleeved in, still, with such a hexagonal squeezing means, known also as an adaptor, there is associated a major problem, and that is failure to account for total sealing feature on the cable end, such that ambient air, moisture can easily make inroads into the cable by way of the ends thereof, and that eventually resulting in impaired screen display compounded with gradual erosion of the cable. To resolve all such shortcomings as noted in the foregoing, there has been introduced a squeezing means which makes possible the tight coupling between connector adaptors and the coaxial cable in question, and which in the meantime accomplishes uniform downscaling of one end of the connector coupling means perimeterically to yield a smooth, slick, rib-free continuum on the surface, highlighted with optimum water-resistant tightness feature.

The inventor is himself a veteran maker in the industry who has gone through years of study and research before finally coming up with this invention, titled squeezing tool.

SUMMARY OF THE INVENTION

The primary object of the invention is to provide a squeezing tool, which makes possible uniform reduction of the perimeter of one end of the connector coupling means to which it is applied, to yield an essentially conical configuration fit for coupling to or interconnection with an object cable.

According to the invention, a squeezing tool for the purpose hereunder is meant to be coupled to a cable coupling means by having a sleeving in the form of a cylinder engaged onto one end of a coaxial cable, the sleeving being composed of a thin layer of amorphous material, the body of the squeezing tool comprising a tilted module support, two axially movable incorporating internally a tilted hole which serves to retain the cable coupling means in place, the cable, by one end thereof, is inserted into the sleeving over the connector coupling section, a grip is fitted to the body by an arbor to facilitate movement of a cranket means closer and closer to or else away from the module surface axialwise, whereby the module is compressed axialwise into the module support, meantime the sleeving about the connector coupling section is squeezed axially to form a tilted surface which looks like a hole apparently, as well as a self-resetting means which will compel the module into the module support and reset itself automatically to a fixed journey.

Said self-resetting means is mounted by a guide rod to the module assembly, onto said guide rod is fitted a spring element which duly actuated by the grip will bring the module assembly compressed into the module support, to the effect that a tightup bonding is secured way between the connector coupling section and the object cable, and what is accomplished in the long run is automatically resetting of the module assembly.

BRIEF DESCRIPTION OF THE DRAWINGS

Other features and advantages of the invention serving to achieve the above-mentioned disclosed hereinafter given together with the following illustrations in which:

FIG. 4 is a longitudinal section view of the invention in an embodiment with which an extrusion operation of an object cable is through.

DETAILED DESCRIPTION OF THE PREFERRED EMBODIMENT

Figure 1:
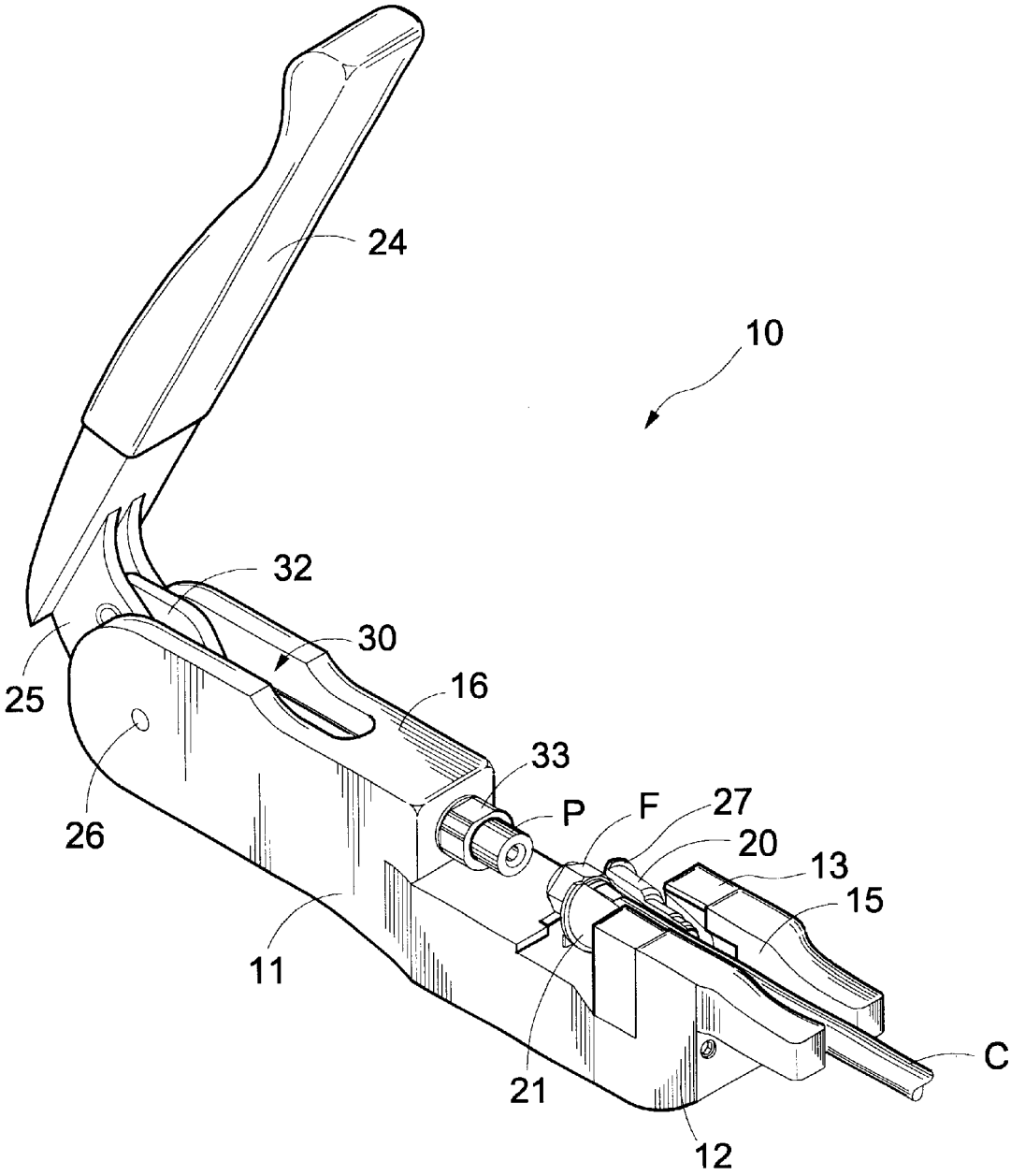
FIG. 1 is a three-dimensional view of the invention.
Figure 2:
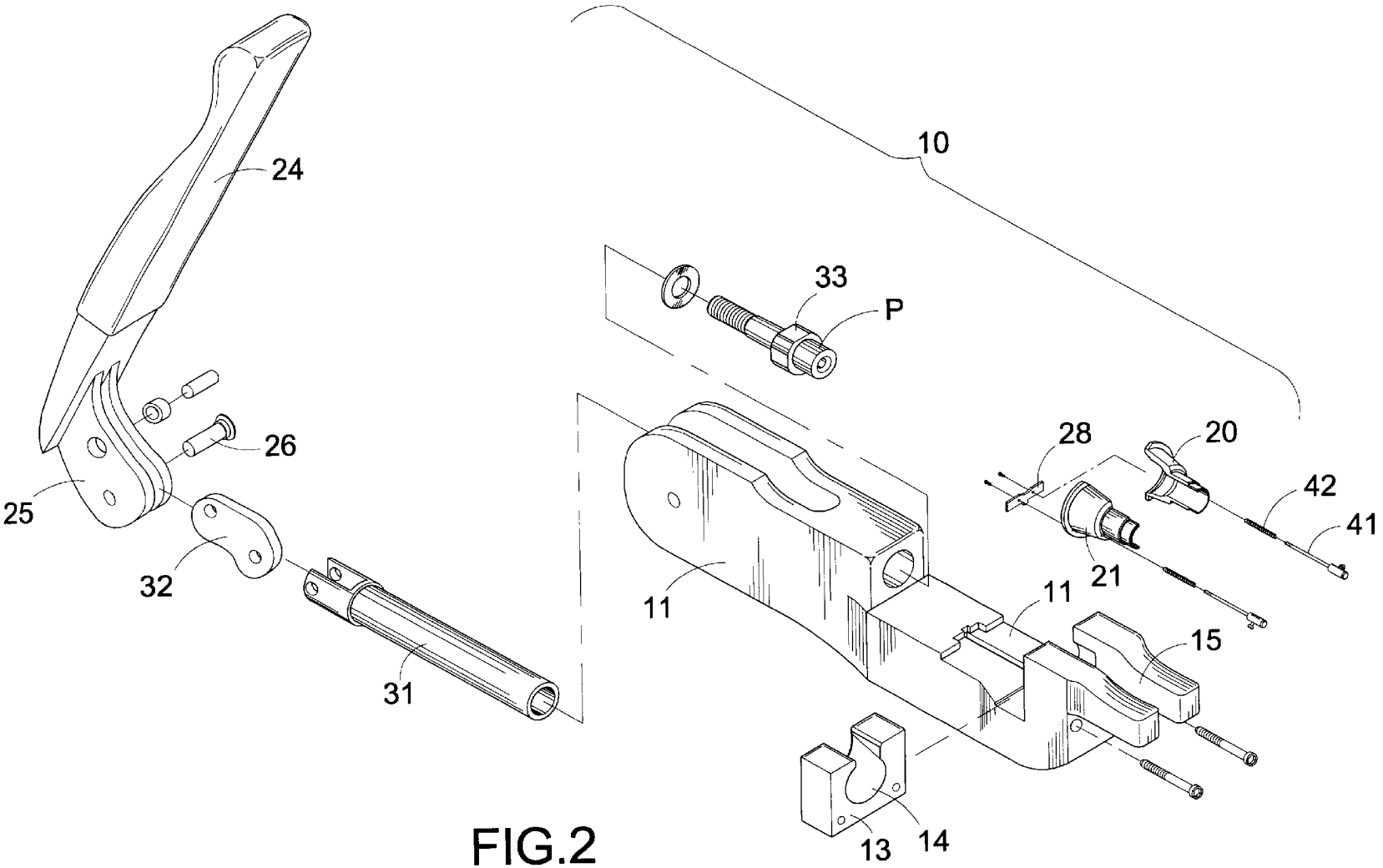
FIG. 2 is a three-dimensional exploded view of the invention.

With reference to FIGS. 1 through FIG. 4, it will be seen that the invention squeezing tool 10 comprises a body 11 bearing a module support end 12 which serves to accommodate a module support mounting 13. On the module support mounting 13 is formed a tilted notch 14 in association with an opening 15, on one end of the body 11. The module support mounting 13 houses two mutually separable modules 20, 21 intervened by a tilted cavity 22 which leads to the opening 15, whereas a sloped surface 23 which resembled and gives the lock of a notch 14 dominates the exteriority of both modules 20, 21. Both modules 20, 21 are associated with each other by means of a coupling means 28 on one end respectively, while the other end of either module is executed free to open or to close up as appropriate.

A cylindric slide 31 that is part of a push rod assembly 30 is free to said slide about in the aperture of a support 16 which, furnished on one end of the body 11, is axially spaced from modules 20, 21, while the slid 31, lying on the axial line of the cavity 22, is axially spaced from the cavity 22. A grip 24, positioned on one end of the body 11, extends outwardly to form an acute angle therewith, and with one end 25 thereof attached to one end of the body 11, the grip 24 is mounted onto the support 16 by an arbor 26, that one end 25 of the grip 24 is coupled to one end of the adapter 32 of the push rod assembly 30, while the other end of the adapter 32 is coupled to the slide 31 which is attached with a chuckhead 33 such that the chuckhead 33 is free to move about axially in the limit defined as illustrated in FIG. 3 and FIG. 4, the module support end 12 and the support 16 are executed integral with the body 11.

On one end of the module 20, 21 is furnished an automatic resetting means 40 which incorporates two guide rods 41 of which one end is attached to module 20, 21 and the guide rod 41 is made to penetrate and rest on the supporting end 12 of the module so as to guide the two modules 20, 21 to displace axially so that both modules 20, 21 are eventually pressed into the module retainer 13, a spring element 42 that is fitted on the guide rod 41 will ensure automatic resetting of modules 20, 21 back to the initial position once the grip 24 is swung away from the support 16, to facilitate extrusion operation with the next oncoming connector coupling and the object cable.

Figure 3A:
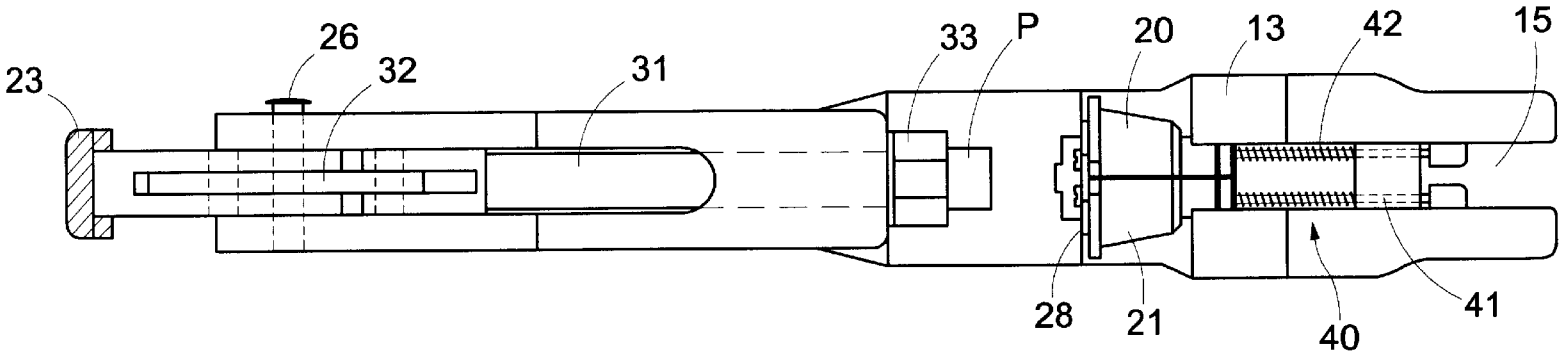
FIG. 3A is a top view of that with respect to which what shown in FIG. 3 is based for the illustration.
Figure 3:
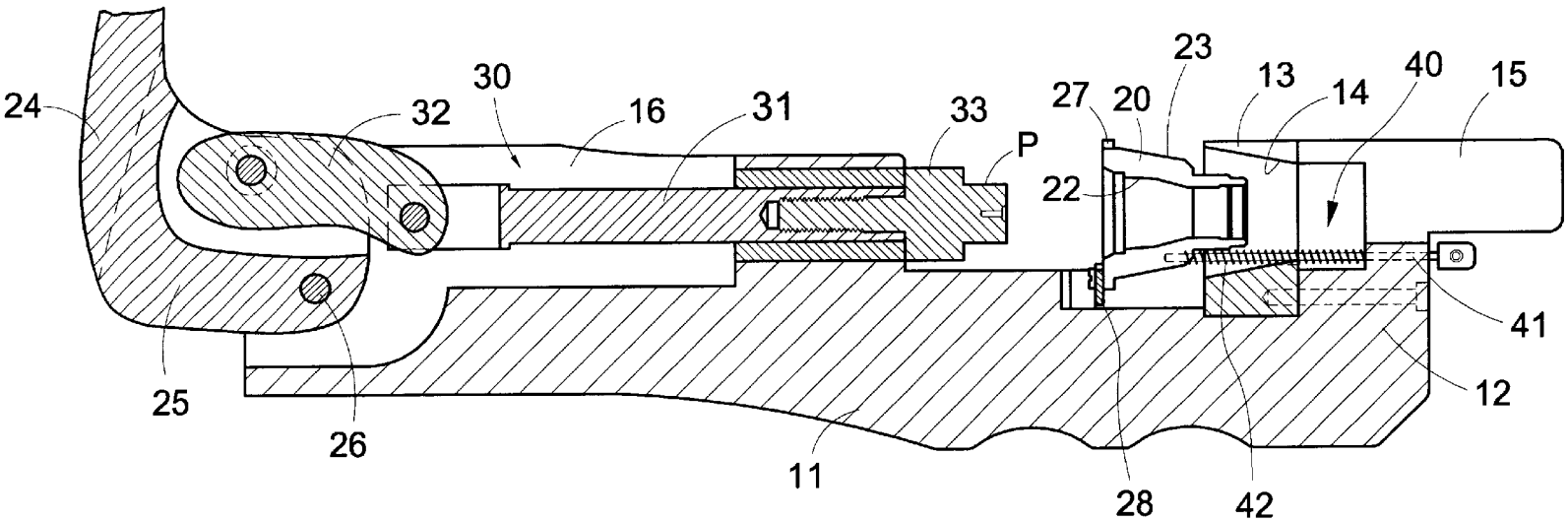
FIG. 3 is a longitudinal section view of the invention.
Figure 4:
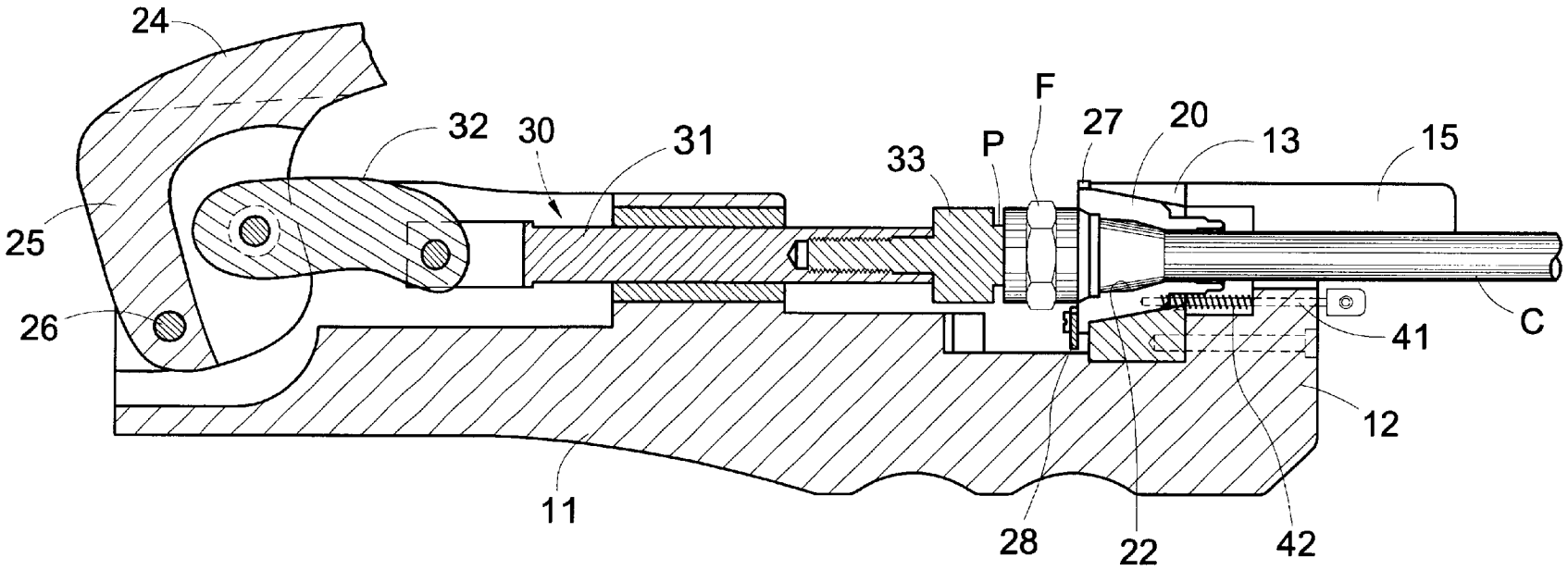

Relative positioning and positional relationship between modules 20, 21 and the retainer therefor 13, the moment the grip 24 is swung to or away from the support 16, are shown in FIG. 3 and FIG. 4 altogether. Such relationship is clearly shown by the squeezing one end of cable C in a state of coupling with an adaptor F; as per FIG. 4. Being firstly placed on one end of the cable C, the adaptor F is then run to pass through cavity 22 and aperture 15 on the modules 20, 21, until it comes bearing upon the center pin P of the chuckhead 33.

When the grip 24 is pressed down way from the position, as shown in FIG. 3 and FIG. 4 to the same purpose, which is in an open condition centered by the arbor 26, the adaptor 32 will move ahead regarding the arbor 26 as a center, meanwhile bringing the slide 31 and chuckhead 33 to move toward modules 20, 21 until the center Pin P bears upon the adaptor F while driving both modules 20, 21 to move forwardly, to eventually compel same 20, 21 into the cavity 14 on the module retainer 13, to closure, the compression thus executed being accompanied with extrusion until coupling is made with respect to one end of the cable. By then the flange 27 on the modules 20, 21 will abut upon the tip of the module retainers 13, thus preventing modules 20, 21 from moving any further ahead, while spring element 42 resets in a compressed state. When all of the aforementioned procedures are through, swing the grip 24 away from the retainer 16 and the spring element 42 will come to a tensioned state meanwhile push modules 20, 21 to their respective initial settings, as illustrated in FIG. 3.

The invention applies axially orientated extrusion to achieve interconnection with connector coupling so that the connector coupling may squeeze radially to consummate in tightup coupling with one end of the cable. As an added advantage, the stroke of journey allowed for the grip is so short that convenient holding of same is achieved, this making special merits for operation constrained in a closed space.

Schematic drawings and descriptions given thus far in the foregoing serve but to illustrate several embodiment of the invention but in no way to limit the scope of application of same; the intent is that all other modifications, variants, revisions of the invention by persons of mediocre skill in the art to the extent within the scope hereof should be deemed not departing from the teachings given herein, and as such taken as covered in the scope of claims appended next hereinafter.

What is claimed is:

1. A squeezing tool for coaxial cable connector, comprising:

a) a body having a module support end and a push rod support end;

b) a module support mounting having a tilted conical interior, the module support mounting is adjoined to the module support end of the body;

c) a module assembly having a tilted conical interior and a tilted conical exterior, the exterior of the module assembly is sized for insertion into the interior of the module support mounting, a small end of the conical interior of the module assembly is sized to accommodate a cable;

d) an automatic resetting assembly adjoined at a first end to the module assembly and at a second end to the module support end of the body;

e) a push rod assembly having a chuckhead at a first push rod end and a moving device rotatably connected to a second push rod end, the push rod assembly is axially spaced from interior of the module assembly, the moving device moves the push rod assembly between an engaging position and a retracted position:

in the engaged position the moving device moves the chuckhead towards the module assembly, the chuck head applies a force against an adaptor located on an exterior circumference of an exposed end of a cable to move the adaptor into the module assembly thereby pushing the module assembly into the module support mounting, and as the chuckhead forces the adaptor into the module assemble the adaptor is squeezed onto the cable, and in the retracted position the push rod assembly moves away from the module assembly and the automatic resetting assembly applies a force against the module support end to reposition the module assembly in the module support mounting.

2. The squeezing tool for coaxial cable connector according to claim 1, wherein the automatic resetting assembly includes a plurality of guide rods and a plurality of springs.

3. The squeezing tool for coaxial cable connector according to claim 1, wherein the module assembly includes two mutually separable modules with a coupling device.

* * * * *